US009447714B2

(12) United States Patent
Khan et al.

(10) Patent No.: US 9,447,714 B2
(45) Date of Patent: Sep. 20, 2016

(54) SYSTEMS AND METHODS FOR COALESCING INTERNAL COMBUSTION ENGINE BLOW-BY

(71) Applicant: GENERAL ELECTRIC COMPANY, Schenectady, NY (US)

(72) Inventors: Musarth Ali Khan, Bangalore (IN); Ramprasad Maruti Shetti, Bangalore (IN); Paul John Fontecchio, Erie, PA (US); Paul Wadding, Erie, PA (US)

(73) Assignee: General Electric Company, Schenectady, NY (US)

( * ) Notice: Subject to any disclaimer, the term of this patent is extended or adjusted under 35 U.S.C. 154(b) by 115 days.

(21) Appl. No.: 14/254,163

(22) Filed: Apr. 16, 2014

(65) Prior Publication Data

US 2015/0300222 A1 Oct. 22, 2015

(51) Int. Cl.
*F01M 13/04* (2006.01)
*F01M 13/02* (2006.01)

(52) U.S. Cl.
CPC ..... *F01M 13/04* (2013.01); *F01M 13/021* (2013.01)

(58) Field of Classification Search
CPC .... F01M 13/00; F01M 13/021; F01M 13/04; F01N 3/0214; F02D 41/0002; F02B 33/44
USPC ..... 55/385.3, 462, 430, 431, 419, 447; 95/272; 60/605.2, 299; 123/41.86, 572, 123/568, 679
See application file for complete search history.

(56) References Cited

U.S. PATENT DOCUMENTS 5,261,946 A * 11/1993 Overby ..... B01D 46/0023 55/282.2
6,640,792 B2 11/2003 Harvey et al.
7,198,718 B1 4/2007 Turnbull
7,235,177 B2 6/2007 Herman et al.
7,343,885 B1 * 3/2008 Marley ..... F01M 13/021 123/41.86
7,540,073 B1 6/2009 Gilstrap
8,017,011 B2 9/2011 Ellis et al.
8,114,183 B2 2/2012 Schwandt et al.
8,114,291 B2 2/2012 Ellis et al.
8,349,061 B2 1/2013 Scheckel et al.
8,545,707 B2 10/2013 Rego et al.
2004/0211181 A1 * 10/2004 Fornof ..... F01N 3/0214 60/605.2
2008/0167791 A1 * 7/2008 Fulton ..... F02D 41/0002 701/108
2009/0025662 A1 * 1/2009 Herman ..... F01M 13/04 123/41.86
2010/0043734 A1 * 2/2010 Holzmann ..... F01M 13/04 123/41.86
2012/0255437 A1 * 10/2012 Fornof ..... B01D 53/261 95/45
2014/0033922 A1 * 2/2014 Peck ..... F01M 13/04 95/272
2015/0048033 A1 * 2/2015 Burns ..... B01D 29/908 210/741

* cited by examiner

*Primary Examiner* — Duane Smith
*Assistant Examiner* — Minh-Chau Pham
(74) *Attorney, Agent, or Firm* — GE Global Patent Operation

(57) ABSTRACT

A system includes at least one coalescer, a blow-by input module, and a boost air module. The at least one coalescer is configured to receive a blow-by mixture, to remove oil from the blow-by mixture to provide an oil drain supply, and to remove gas from the blow-by mixture to provide a gas vent supply. The coalescer is configured to receive an operational air supply. The blow-by input module is operably coupled to the at least one coalescer and configured to receive the blow-by mixture from a crankcase of an internal combustion engine and provide the blow-by mixture to the at least one coalescer. The boost air module is operably coupled to the at least one coalescer and configured to receive an air supply from an intake conduit of the internal combustion engine and to provide the air supply as the operational air supply to the at least one coalescer.

20 Claims, 12 Drawing Sheets

SYSTEMS AND METHODS FOR COALESCING INTERNAL COMBUSTION ENGINE BLOW-BY

BACKGROUND

During operation of an internal combustion engine, oil may be mixed with blow-by gases (e.g., gases that have escaped from one or more cylinders to the crankcase) to create a blow-by mixture in the crankcase. For efficiency concerns, as well as emission concerns, it may desirable to remove blow-by from the crankcase and to use a coalescer to separate the blow-by mixture into gaseous and oil components.

Past attempts to utilize coalescers to separate oil from gases of a blow-by mixture included the mounting of one or more coalescers at the rear end of an engine (e.g., toward an alternator) to vent separated gases to a downstream portion of an after treatment system (ATS). A coalescer boost air supply was provided from an exhaust system in certain previous attempts to use coalescers.

However, certain engine system may not include an ATS for venting of the separated gases. Further, the routing of hoses and piping for conventional coalescer systems, for example, on locomotives may be quite lengthy and/or complex, resulting in increased difficulty for installation and/or maintenance. Further still, the coalescers of conventional system may have locations resulting in difficult installation, difficult access, and/or inconvenient maintenance. Yet further still, conventional approaches may result in relatively poor emission levels, relatively expensive cost, relatively poor reliability, and/or relatively increased consumption of oil.

BRIEF DESCRIPTION

In an embodiment, a coalescing system includes at least one coalescer, a blow-by input module, and a boost air module. The at least one coalescer is configured to receive a blow-by mixture from an internal combustion engine, to remove oil from the blow-by mixture to provide an oil drain supply from the at least one coalescer, and to remove gas from the blow-by mixture to provide a gas vent supply from the at least one coalescer. The coalescer is configured to receive an operational air supply. The blow-by input module is operably coupled to the at least one coalescer and configured to receive the blow-by mixture from a crankcase of the internal combustion engine and provide the blow-by mixture to the at least one coalescer. The boost air module is operably coupled to the at least one coalescer and configured to receive an air supply from an intake conduit of the internal combustion engine and to provide the air supply as the operational air supply to the at least one coalescer.

In another embodiment, a system includes an internal combustion engine, at least one coalescer, a blow-by input module, and a boost air module. The internal combustion engine includes an intake conduit configured to provide an inlet stream of air for combustion by the internal combustion engine, a crankcase, an exhaust conduit configured to provide an outlet for combustion products, and an oil reservoir. The at least one coalescer is configured to receive a blow-by mixture from the crankcase of the internal combustion engine, to remove oil from the blow-by mixture to provide an oil drain supply from the at least one coalescer, and to remove gas from the blow-by mixture to provide a gas vent supply from the at least one coalescer. The coalescer is also configured to receive an operational air supply. The blow-by input module is operably coupled to the at least one coalescer and configured to receive the blow-by mixture from the crankcase of the internal combustion engine and provide the blow-by mixture to the at least one coalescer. The boost air module is operably coupled to the at least one coalescer and configured to receive an air supply from the intake conduit of the internal combustion engine and to provide the air supply as the operational air supply to the at least one coalescer.

In another embodiment, a method includes positioning at least one coalescer proximate to an internal combustion engine. The at least one coalescer is configured to receive a blow-by mixture from an internal combustion engine, to remove oil from the blow-by mixture to provide an oil drain supply from the at least one coalescer, and to remove gas from the blow-by mixture to provide a gas vent supply from the at least one coalescer. The coalescer is configured to receive an operational air supply. The method also includes operably connecting a blow-by input module to the at least one coalescer and to a crankcase of the internal combustion engine, wherein the blow-by input module receives the blow-by mixture from a crankcase of the internal combustion engine and provides the blow-by mixture to the at least one coalescer. Further, the method includes operably connecting a boost air module to the at least one coalescer and an intake conduit of the internal combustion engine, wherein the boost air module receives an air supply from an intake conduit of the internal combustion engine and provides the air supply as the operational air supply to the at least one coalescer.

BRIEF DESCRIPTION OF THE DRAWINGS

The inventive subject matter will be better understood from reading the following description of non-limiting embodiments, with reference to the attached drawings, wherein below.

DETAILED DESCRIPTION

One or more examples of the inventive subject matter described herein provide methods and systems for improved separation of oil from gases in a blow-by mixture. For example, one or more coalescers may receive a boost air supply from an intake conduit of a diesel engine and/or be mounted to a front end (e.g., mounted to an EGR intercooler disposed on the front end of the diesel engine). It may be noted that while the examples discussed herein are discussed in the context of diesel engines, various examples may be used with other types of internal combustion engines. For example, with the one or more coalescers disposed in a readily accessible location along the front end of an engine and supplied with a boost air supply from an intake conduit of the diesel engine, relatively short and/or simple fluid connections between the one or more coalescers and aspects of the diesel engine may be utilized.

At least one technical effect of various examples discussed herein includes improved engine and/or coalescer efficiency due to reduced hose and/or piping lengths and/or reducing the oil aerosol carry over to coalescer units. At least one technical effect of various examples discussed herein includes improved exhaust emissions and reduced oil carry over to an exhaust stack (and in turn to the environment), for example due to improved coalescer performance resulting from improved routing of one or more of a boost air supply, a blow-back mixture from a crankcase, a vent gas supply to an exhaust stack, or an oil return line to an oil reservoir. At least one technical effect of various examples discussed herein includes reduced engine lube oil consumption, for example due to reduced oil carry over to the coalescer. At least one technical effect of various examples discussed herein includes reduced cost, for example reduced cost due to improved maintenance and/or use of fewer coalescers due to improved coalescer efficiency. At least one technical effect of various examples discussed herein includes improved accessibility of the system, for example via use of a readily accessible exterior surface of an EGR intercooler. At least one technical effect of various examples discussed herein includes utilization of previously unused or under-utilized space between a Rad cab and an engine cab. At least one technical effect of various examples discussed herein includes flexible and reliable conduit runs, e.g., via the use of a combination of flexible hoses and rigid piping. At least one technical effect of various examples discussed herein includes reduced size and/or weight of mounting brackets and/or hardware for securing one or more coalescers to a diesel engine.

Figure 1:
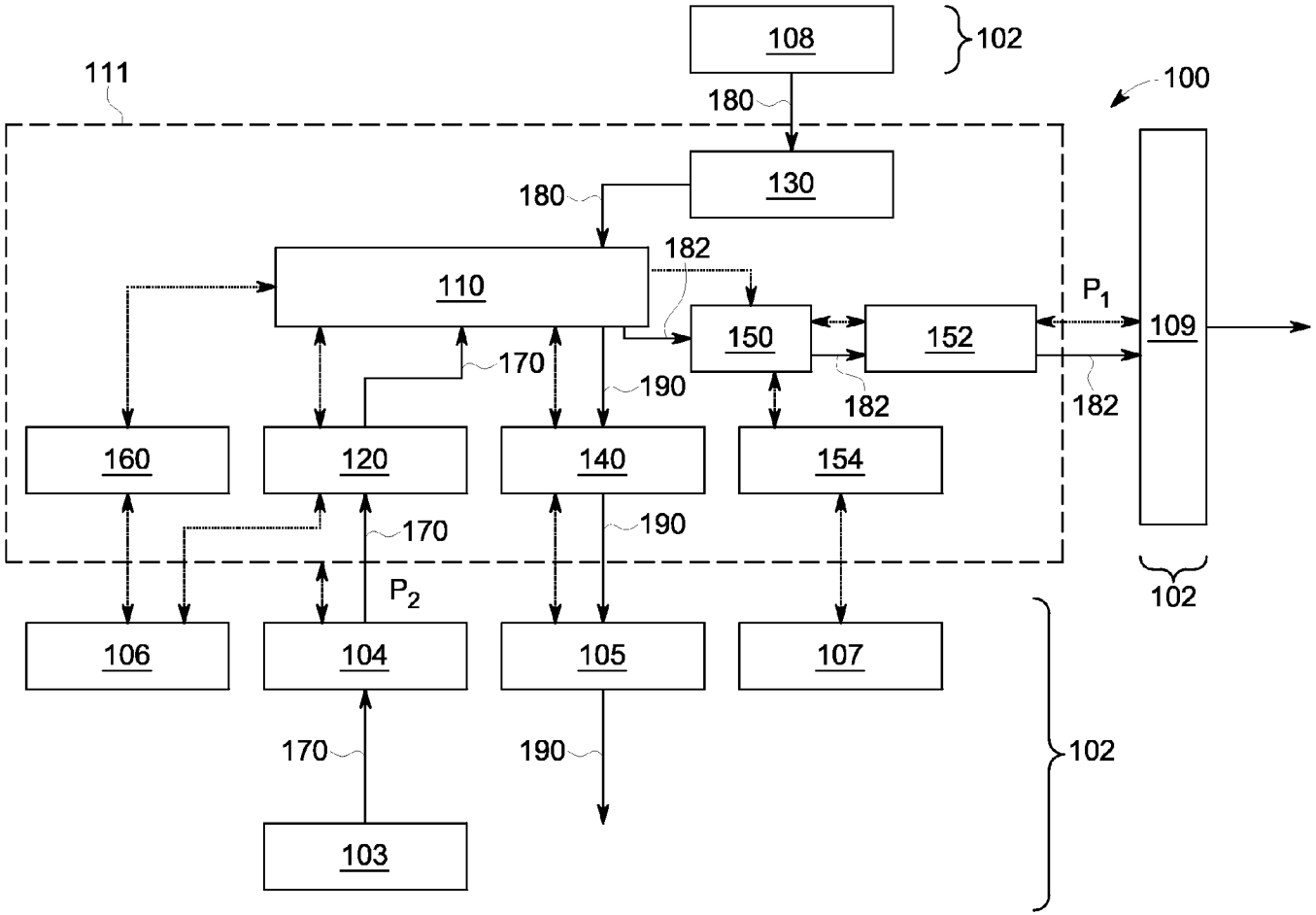
FIG. 1 is a schematic block diagram of an engine system, according to an embodiment of the invention.
Figure 2:
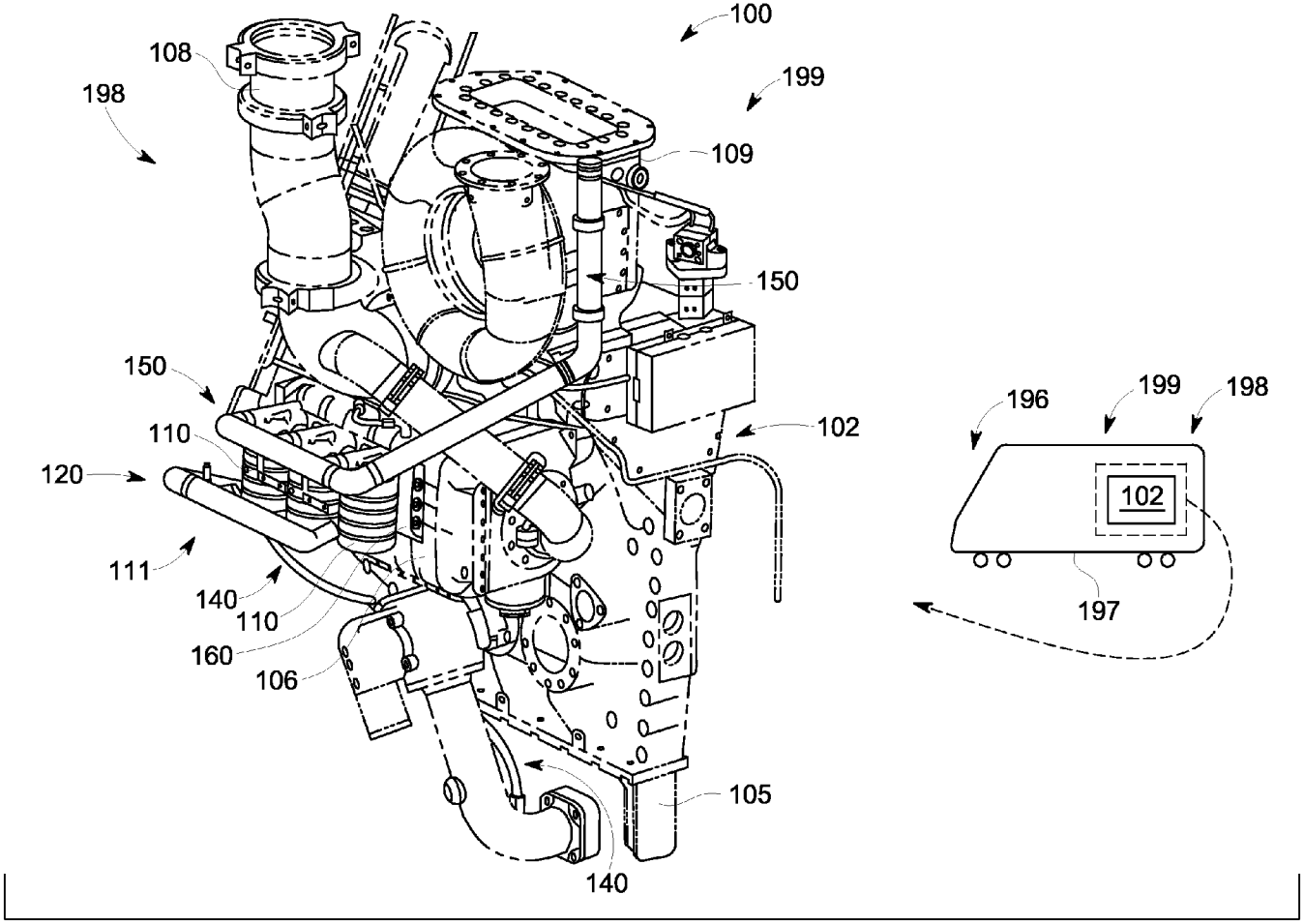
FIG. 2 is a perspective view of the engine system of FIG. 1.

FIG. 1 is block diagram and FIG. 2 is perspective view of an engine system 100 formed in accordance with an embodiment of the invention. For example, the engine system 100 may be configured as a diesel engine system for providing motive power for rail applications or marine applications, among others. As one example, the engine system 100 may be mounted to a powered rail vehicle (e.g., locomotive). The depicted engine system 100 includes a coalescer system 111 and a diesel engine 102.

The diesel engine 102 is configured as an internal combustion engine that uses combustion of diesel fuel from a fuel tank (not shown) and air from an environment to actuate one or more cylinders that in turn actuate a crank. An output from the crank may be provided to a generator and used to generate electrical energy for providing motive power to a vehicle and/or for storage for later use and/or to power electrical systems of the vehicle. With continued reference to FIGS. 1 and 2, the diesel engine 102 includes a crank case 103, an integrated front end (IFE) 104, an oil reservoir 105, an intercooler 106 (e.g., an exhaust gas recirculation (EGR) unit), a turbo unit 107, an intake conduit 108, and an exhaust conduit 109. The crank case 103 is configured to house the crank and to provide lubrication to the crank. The oil reservoir 105 is configured to store oil for distribution to and use by various portions of the diesel engine 102 for lubricating moving parts of the diesel engine 102. The oil reservoir 105 may include one or more oil pans. The turbo unit 107 may be configured, for example, to increase the flow and/or pressure of air supplied to pistons for internal combustion. The intake conduit 108 is configured to provide air from an environment to the pistons for combustion. The intake conduit 108 may include one or more intake ports, tubes, pipes, or hoses for providing air to the cylinders. The intake conduit 108, for example, may include a manifold configured to distribute air among cylinders. Further, the intake conduit 108 may include one or more air filters for removing particulate from the air before the air is provided to the cylinders for combustion. The exhaust conduit 109 is configured to provide a conduit through which exhaust gases (e.g., products of combustion) from the cylinders may be expelled from the engine system 100. The exhaust conduit 109 may include, for example, a muffler and/or rain trap. The intercooler 106 may be configured, for example as an EGR cooler.

As best seen in FIG. 2, the engine system 100 includes a front end 198 and a back end 199. The front end 198, as used herein, corresponds to an intake end of the engine system 100. The front end 198 may be understood as one end of the engine as defined by a long axis of the engine. Further, in various embodiments, the front end 198 may be disposed opposite an output end that provides an output to a transmission. As seen in FIG. 2, the intake conduit 108 of the diesel engine 102 is positioned proximate the front end 198. It may be noted that, as seen in the additional view provided on the right side of FIG. 2, the front end 198 of the diesel engine 102 may not be positioned proximate to or oriented toward a front end or cab forward position 196 of a powered rail vehicle 197 (e.g., locomotive) to which the diesel engine 102 is mounted. For example, as seen in FIG. 2, in the illustrated embodiment, the front end 198 of the diesel engine 102 is oriented toward the back of the powered rail vehicle 197, or away from the cab forward position 196 of the powered rail vehicle 197.

The coalescer system 111 is configured to separate oil from other portions of a blow-by mixture from the crankcase 103 of the diesel engine 102. In operation, the compressed fuel/air mixture in the cylinders of the diesel engine 102 may leak past one or more pistons to the crankcase. This compressed fuel/air mixture is referred to herein as blow-by. The blow-by may reduce engine power and build up pressure in the crankcase to undesirable levels. However, while in the crankcase, the blow-by may mix with oil (e.g., an oil mist) in the crankcase, making removal of the blow-by (e.g., as part of the blow-by mixture) difficult, as well as expending oil and/or creating undesirable emissions if the blow-by mixture is released directly to the environment.

Accordingly, the coalescer system 111 may be used to separate the oil portion of the blow-by mixture from the gas portion of the blow-by mixture. It should be noted that as used herein, the gas portion of the blow-by mixture refers to a gaseous form of one or more of fuel, air, and/or fuel/air mixture, and not necessarily to "gasoline." The coalescer system 111 may also be configured to provide filtration as well.

The depicted coalescer system 111 includes a coalescer 110, a blow-by input module 120, a boost air intake module 130, an oil output module 140, an outlet gas module 150, and a bracket 160. The coalescer 110 is configured to separate oil from other components of a blow-by mixture (e.g., a blow-by mixture received from the crankcase 103 of the diesel engine 102). The blow-by input module 120 is configured to receive a blow-by mixture from the crankcase 103 and provide the blow-by mixture to the coalescer 110. The boost air intake module 130 is configured to receive an air supply from the intake conduit 108 of the diesel engine 102, and to provide the air supply as an operational air supply to the coalescer 110. The oil output module 140 is configured to receive an oil drain supply provided by the coalescer 110 (e.g., a supply of oil separated from the blow-by mixture by the coalescer 110), and to provide the oil drain supply to the oil reservoir 105. The outlet gas module 150 is configured to receive a gas vent supply from the coalescer 110 (e.g., a gas vent supply including a gas from a blow-by mixture from which oil has been separated or removed, and/or including air from the operational air supply provided from the intake conduit 108 via the boost air module 130), and to provide the gas vent supply to the exhaust conduit 109. The bracket 160 is configured to secure the coalescer 110 to the diesel engine 102. In the illustrated embodiment, the coalescer 110 is secured to the diesel engine 102 proximate the front end 198 of the diesel engine 102, for example to an intercooler 106, via the bracket 160.

As seen in FIG. 1, various blocks are interconnected or otherwise associated with one or more other blocks via solid lines terminating in an arrow and/or dotted lines. As shown in FIG. 1, a solid line terminating in an arrow indicates the flow of a fluid (e.g., a gas or a liquid, or a mixture thereof), with the arrow indicating the direction of the flow. A dotted line indicates a mechanical interface or connection. A dotted line between blocks of FIG. 1 may represent one or more of bolted or otherwise secured joints, clamps, threaded fittings, gaskets, or seals between the blocks configured for mating, joining, securing, or otherwise associating the two blocks mechanically or physically.

As seen in FIG. 1, a blow-by mixture follows a path 170 from the crankcase 103 to the coalescer 110. One or more components or aspects of the diesel engine 102 and/or the coalescer system 111 may be interposed between the coalescer 110 and the crankcase 103 along the path 170. For example, the blow-by mixture may follow the path 170 from the crankcase 103 (e.g., from an outlet port or fitting of the crankcase 103) to the IFE 104 (it may be noted that in some examples, the crankcase may form a part of the IFE 104), from the IFE 104 to the blow-by input module 120, and from the blow-by input module 120 to the coalescer 110 (e.g., through the blow-by input module 120 and into the coalescer 110 via an inlet port or fitting of the coalescer 110). The various blocks or components may include one or more ports for accepting the flow and/or expelling the flow therefrom, as well as one or conduits for passage of the flow. For example, the coalescer 110 may include a blow-by inlet port, the crankcase 103 may include a blow-by outlet port, and the blow-by input module 120 may include one or more pipes, tubes, hoses, fittings, or the like. The blow-by mixture is accepted by the coalescer 110, and the coalescer 110 separates oil from a gas (e.g., a gaseous fuel/air mixture) to provide an oil drain supply and a gas vent supply that exit from the coalescer 110.

The coalescer 110 also receives a boost air supply that follows a path 180 from the intake conduit 108 to the boost air intake module 130, and from the boost air intake module 130 to the coalescer 110. The boost air supply provides an operational air supply, for example to operate a vacuum or other pressure differential utilized by the coalescer 110 to separate oil from the blow-by mixture. The gas separated from the oil as well as any of the used boost air supply may be removed from the coalescer 110 via a path 182. The path 182 flows from the coalescer 110 to the gas output module 150 (e.g., from an outlet port or fitting of the coalescer 110), and from the gas output module 150 to the exhaust conduit 109 of the diesel engine 102 (e.g., through the gas output module 150 to the exhaust conduit 109 via a stack outlet 152). The gas output module 150, for example, may be secured to the turbo unit 107 via a hose support 154. It may be noted that "P1" depicted at an entry to the exhaust conduit 109 may be lower than "P2" depicted at an exit of the crankcase 103 for the blow-by mixture to allow one or more of the indicated flows to occur.

Once the oil has been separated from the blow-by mixture, the oil may be provided from the coalescer 110 to the oil reservoir 105 along a path 190. The path 190 in the illustrated embodiment flows from the coalescer 110 to the oil output module 150. The path 190 may flow from the coalescer 110 to the oil output module 140 (e.g., from an outlet port or fitting of the coalescer 110 into the oil output module 140), and from the oil output module 140 to the oil reservoir 105 (e.g., through the oil output module 140 and into the oil reservoir 105 via an inlet port or fitting of the oil reservoir 105). Oil may be distributed from the oil reservoir 105 to one or more locations of the diesel engine 102 for lubrication.

The coalescer 110 is configured to separate oil from a gaseous flow of the blow-by mixture obtained from or provided by the crankcase 103. The coalescer 110 may also be configured to act as a filter (e.g., for particulate) as well. In the illustrated embodiment, the coalescer 110 is configured as a multi-stage coalescer. For example, the coalescer 110 may include a pre-separator portion (e.g., a cyclonic pre-separator) that provides an initial separation of oil from the blow-by mixture. Following the pre-separator, the coalescer 110 may have a first stage separator and a second stage separator. The blow-by mixture may enter the first stage separator were oil particles are absorbed by a diaphragm (e.g., a flexible diaphragm made of one or more of paper, rubber, or the like). After the first stage, the blow-by mixture may enter the second stage separator were further separation of the oil from the gases takes place under higher pressure. A vacuum for the second stage (to create a higher pressure differential) may be created using boost air supplied from the intake conduit 108 to the coalescer 110 via the boost air intake module 130. The created vacuum, for example, may assist in squeezing the diaphragm and removing oil from the diaphragm.

Figure 3:
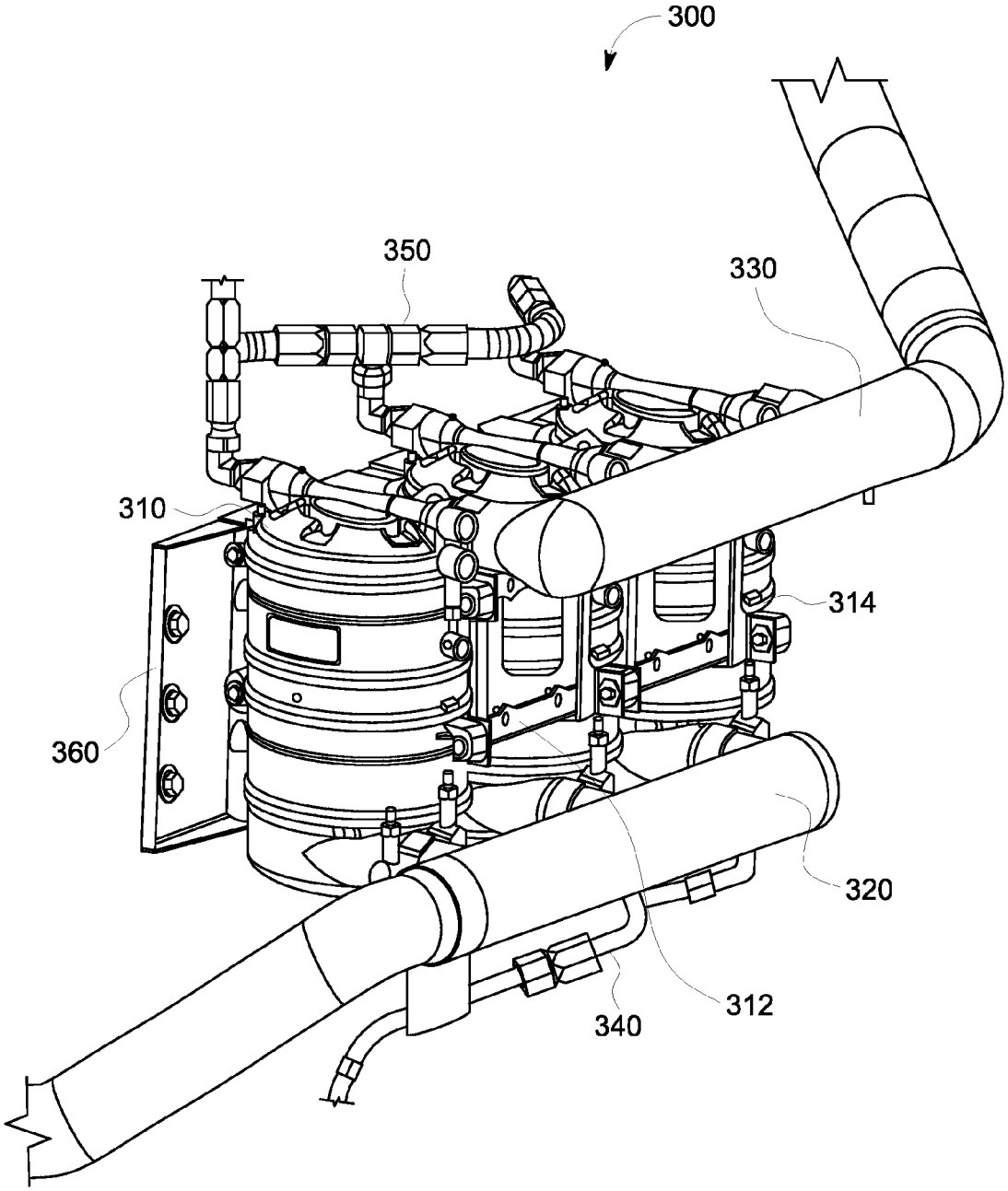
FIG. 3 is a perspective view of a coalescer system, according to an embodiment.

It may be noted that in various embodiments, the block corresponding to the coalescer 110 may include more than one coalescer, for example two or more coalescers configured in parallel and receiving and/or providing flows via manifolds that form portions of the various modules operably coupling the coalescer with various portions, systems, components, or aspects of the diesel engine 102. FIG. 3 provides a perspective view of a coalescer system 300 that includes three coalescers. (The embodiment depicted in FIG.

2 also includes three coalescers.) The coalescer system 300 includes a first coalescer 310, a second coalescer 312, and a third coalescer 314. The coalescers 310, 312, 314 are coupled in parallel to a crankcase (e.g., crankcase 103) to receive a blow-by mixture via an input manifold 320 that forms part of a blow-by input module (e.g., blow-by input module 150). Similarly, the coalescers 310, 312, 314 are coupled in parallel to the exhaust system (e.g., exhaust conduit 109) of a diesel engine via an output manifold 330 that forms part of a gas output module (e.g., gas output module 150). Further, the coalescers 310, 312, 314 are coupled in parallel to an oil reservoir (e.g., oil reservoir 105) of a diesel engine via an oil output manifold 340 that forms part of an oil output module (e.g., oil output module 140). Further, the coalescers 310, 312, 314 are coupled in parallel to a boost air supply (e.g., from an intake system or component such as the intake conduit 108) of a diesel engine via a boost air manifold 350 that forms part of a boost air module (e.g., boost air module 130). A bracket 360 secures the coalescers 310, 312, 314 in place. By providing a plurality of coalescers (e.g., three or more coalescers mounted to available space proximate an intercooler disposed proximate a front end of the diesel engine) various embodiments provide for substantial improvement in the amount of oil that may be removed from blow-by gases in comparison to conventional mountings and arrangements that only allow for a single coalescer, and/or conventional mountings and arrangements that provide less advantageous pathways or conduits for the passage of gases and/or liquids between the coalescers and one or more aspects of a diesel engine.

Figure 4:
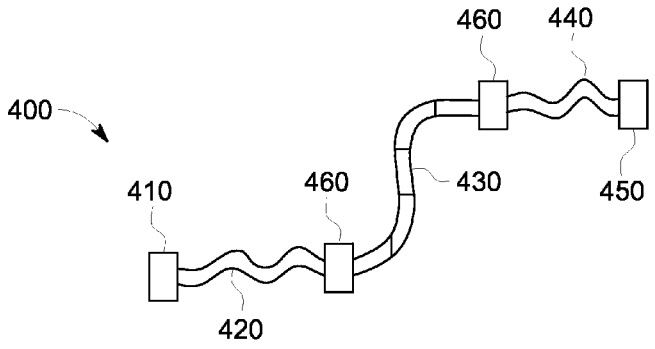
FIG. 4 provides a view of a conduit module, according to an embodiment.

Certain modules described herein are configured to provide conduits or passageways for the passage of flow between the coalescer 110 and the diesel engine 102. The modules may be configured for passage of fluids (e.g., gases, liquids, or a mixture thereof). The modules may not be understood as a part of a coalescer itself, but instead understood as providing a route, path, and/or passageway for distributing one or more fluids to the coalescer and/or from the coalescer. FIG. 4 provides a view of an example conduit module 400 formed in accordance with an example of the present inventive subject matter. One or more of the applies to blow-by input module 120, a boost air intake module 130, an oil output module 140, an outlet gas module 150 may be generally configured similarly to or include or incorporate one or more aspects of the conduit module 400.

As seen in FIG. 4, the conduit module 400 includes an inlet port 410, a first hose 420, a pipe 430, a second hose 440, an outlet port 450, and fittings 460. It may be noted that the particular arrangement depicted in FIG. 4 is provided by way of example only, and that, for example, additional segments of pipe and/or hose may be provided in various examples. As another example, one or more of the aspects shown in FIG. 4 may include or be configured as a manifold having a plurality of inlets or outlets, for example, for a corresponding plurality of coalescers.

The inlet port 410 is configured to be operably connected to a component or aspect of a coalescer or diesel engine, and to receive a flow from the component or aspect to which the inlet port 410 is connected. The inlet port 410, for example, may include a threaded fitting. The inlet port 410 is configured to be operably connected to a component or aspect of a coalescer or diesel engine, and to receive a flow from the component or aspect to which the inlet port 410 is connected. The inlet port 410, for example, may include a threaded fitting. The outlet port 450 is configured to be operably connected to a component or aspect of the coalescer or diesel engine, and to provide a flow to the component or aspect to which the outlet port 450 is connected. The outlet port 450, for example, may include a threaded fitting.

The first hose 420, the pipe 430, and the second hose 440 form a pathway between the inlet port 410 and the outlet port 450 through which a flow may pass from the coalescer to a portion or aspect of the diesel engine, and/or vice versa. The first hose 420 and the second hose 440 may be flexible hoses configured to allow for convenient positioning of the inlet port 410 and outlet port 450 and joining of the ports to ports or fittings of the coalescer and/or aspects of the diesel engine. The pipe 430 is interposed between the first hose 420 and the second hose 440, and may be generally rigid or inflexible. The pipe 430 may provide for convenient mounting to engine components (e.g., via clamps, joints, or the like) while also providing rigidity and durability. The pipe 430 may include one or more elbows configured to provide a desired shape (e.g., to traverse around a given portion of the engine). The combination of the hoses and the pipe provide for a rigid, durable fluid path while still allowing for flexibility for installation and mounting convenience. The fittings 460 provide a fluid-tight joining between the hoses and the pipe 430.

As one example, the conduit module 400 may be configured as a boost air intake module, and may have an engine fitting (e.g., inlet port 410) that mates with an outlet of the intake conduit 108, as well as a coalescer fitting (e.g., outlet port 450) that mates with an inlet of the coalescer 110, with a boost air supply being provided from the intake of the engine to the coalescer via the conduit module 400.

Returning to FIG. 1, as indicated above, the depicted blow-by input module 120 is configured to receive a blow-by mixture from the crankcase 103 and provide the blow-by mixture to the coalescer 110. The blow-by input module 120 may be understood as a conduit between the coalescer 110 and the crankcase 103 through which a blow-by mixture flows from the crankcase to the coalescer 110. The blow-by input module 120 may include a port or manifold for providing the blow-by mixture to one or more coalescers.

Figure 5:
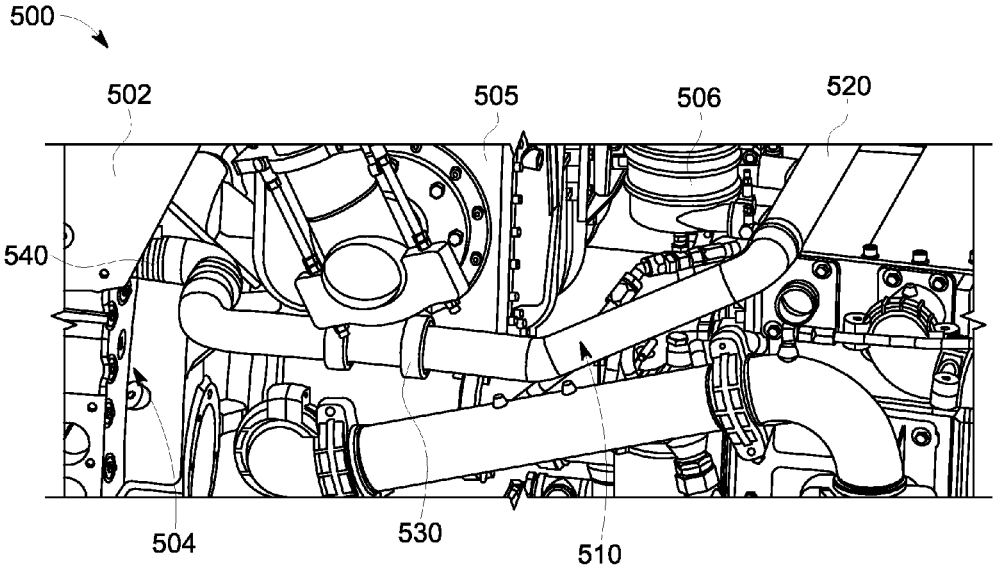
FIG. 5 provides a perspective view of a blow-by input module, according to an embodiment.

FIG. 5 provides a perspective view of a blow-by input module 500 formed in accordance with an example of the present inventive subject matter (see also FIG. 2 for an additional view of the depicted assembly). The blow by input module 500 is configured to provide a blow-by mixture from the crankcase 502 and/or IFE assembly 504 to one or more coalescers 506 (see, e.g., FIG. 3 and related discussion for an example of a blow-by inlet manifold).

The depicted blow-by input module 500 includes a pipe 510, a manifold 520, a clamp 530, and a threaded fitting 540. The threaded fitting 540 is configured to provide a fluid-tight joining with the IFE assembly 504 for the passage of the blow-by mixture from the diesel engine into the blow-by input module 500. The pipe 510 provides a pathway between the IFE assembly 504 and the coalescer(s) 506. The pipe 510 may include one or more bends, elbows, curved portions, or the like to conform to a desired and/or available pathway (e.g., to minimize or reduce the distance traveled by the blow-back mixture while still providing for convenient assembly and/or maintenance). The manifold 520 may be flexible (e.g., a flexible length of tubing or hose) and include a plurality of outlets for a corresponding plurality of coalescers. The manifold 520 (e.g., the manifold outlets) may be secured to the coalescers via clamps (e.g., a hose clamp proximate to each inlet of the coalescers). The clamp 530 is configured to secure the pip 510 to a portion of a diesel engine, such as an EGR cooler 505.

Returning to FIG. 1, the illustrated boost air intake module 130 is configured to receive an air supply from the intake conduit 108 of the diesel engine 102, and to provide the air supply as an operational air supply to the coalescer 110. An operational air supply as used herein may be understood to include a supply of air used by the coalescer 110 to separate portions of a different supply or stream (e.g., a blow-by mixture from a separate stream or flow-path than the operational air supply). For example, the air supply provided via the air intake module 130 may be configured to provide a vacuum used to separate oil from other components of the blow-by mixture. The air intake module 130 may be understood as a conduit between the air intake conduit 108 and the coalescer 110 through which an operational air supply flows from the intake conduit 108 to the coalescer 110. The boost air intake module 130 may include a port or manifold for providing the blow-by mixture to one or more coalescers.

Figure 6:
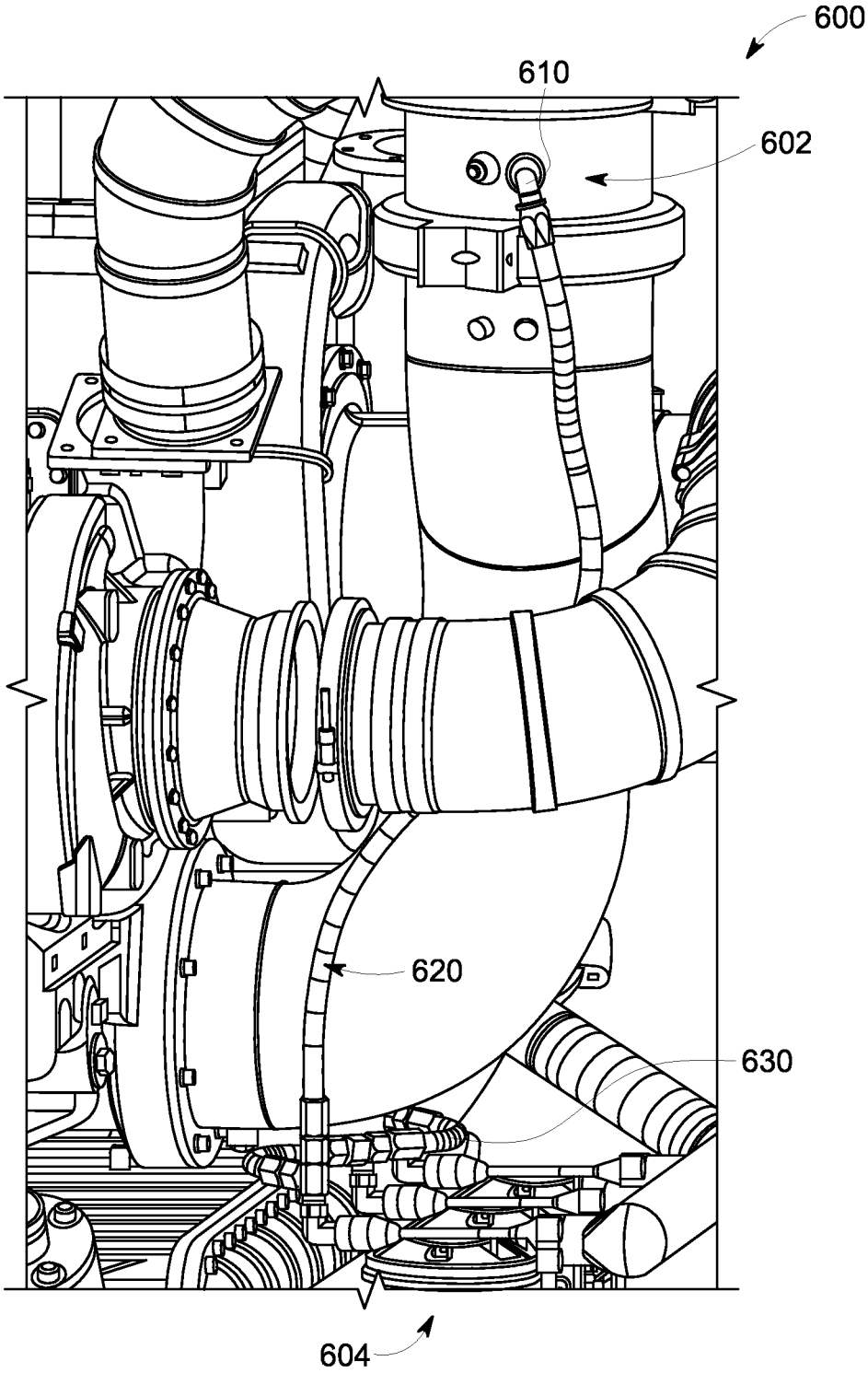
FIG. 6 provides a perspective view of a boost air module, according to an embodiment.

FIG. 6 provides a perspective view of a boost air intake module 600 formed in accordance with an example of the present inventive subject matter (see also FIG. 2 for an additional view of the depicted assembly). The depicted boost air intake module 600 is configured to receive an air supply from the intake conduit 602 of a diesel engine (e.g., intake pipe) and to provide a boost air supply to one or more coalescers 604 (e.g., an air supply used to provide a vacuum for improved separation of oil and gases in the blow-by mixture provided from a crankcase) to the one or more coalescers 604.

The depicted boost air intake module 600 includes an inlet port 610, a boost air hose 620, and a boost air manifold 630. The inlet port 610 is configured to receive an air supply from the intake conduit 602. The inlet port 610, for example, may include a threaded fitting accepted by a thread of the intake conduit 602 to provide an air-tight seal for passage of air from the intake conduit 602 into the boost air hose 620. The boost air hose 620 may be flexible to provide for convenient installation and routing. The boost air manifold 630 may be flexible (e.g., a flexible length of tubing or hose with one or more fittings to outlet ports and/or outlet segments of hose or tubing) and include a plurality of outlets for a corresponding plurality of coalescers.

With returned reference to FIG. 1, the depicted oil output module 140 is configured to receive an oil drain supply provided by the coalescer 110 (e.g., a supply of oil separated from the blow-by mixture by the coalescer 110), and to provide the oil drain supply to the oil reservoir 105. The oil output module 140 may be understood as a conduit between the coalescer 110 and the oil reservoir 108 through which oil separated from a blow-by mixture flows from the coalescer 110 to the oil reservoir 108. The oil output module 140 may include a port or manifold for accepting oil supplied from one or more coalescers (e.g., oil separated from a blow-by mixture by the one or more coalescers).

Figure 7:
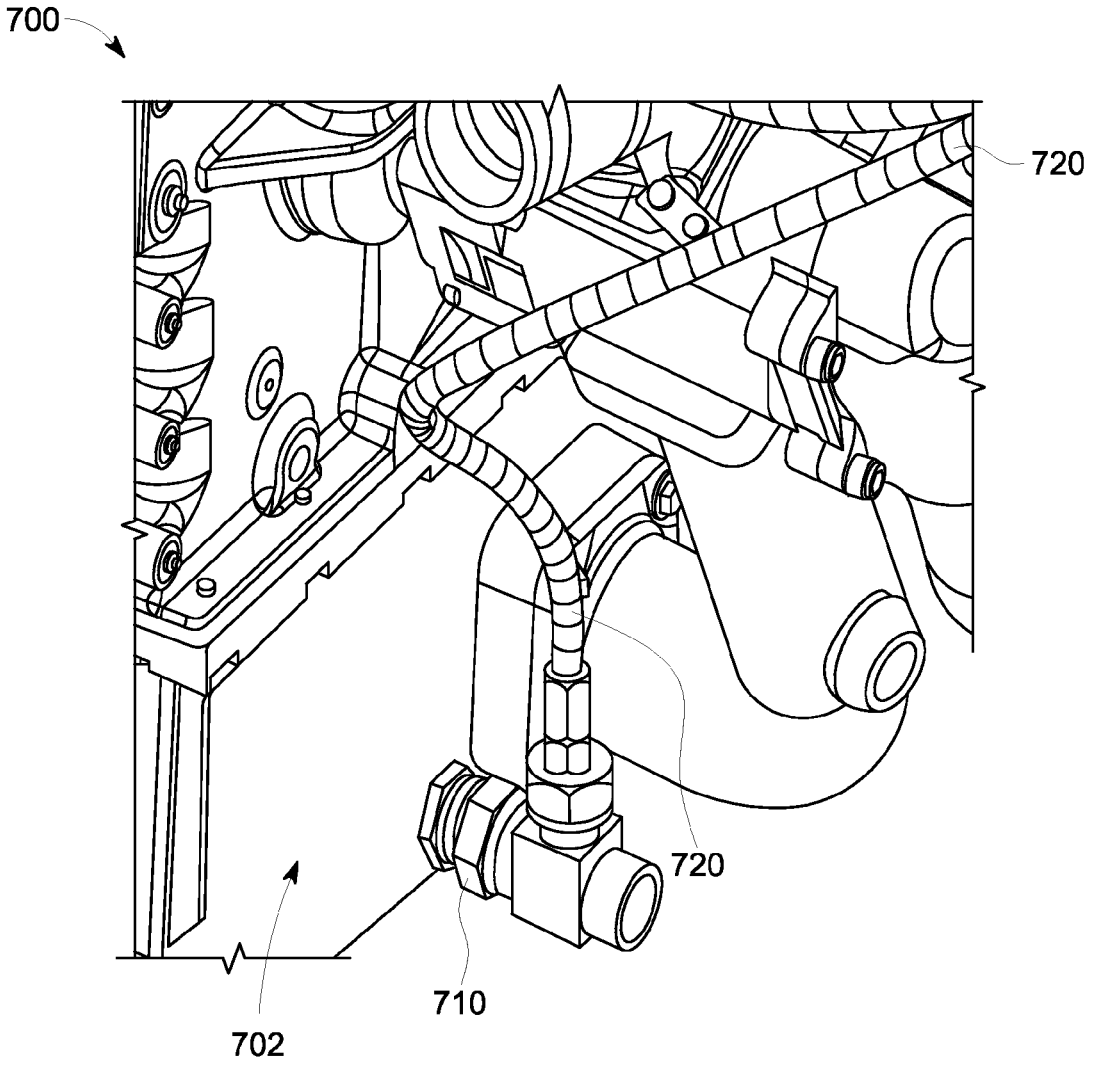
FIG. 7 provides a perspective view of an oil supply module, according to an embodiment.

FIG. 7 provides a perspective view of an oil output module 700 formed in accordance with an example of the present inventive subject matter (see also FIG. 2 for an additional view of the depicted assembly). The oil output module 700 is configured to provide oil separated by one or more coalescers from a blow-by mixture from the one or more coalescers to an oil reservoir 702 (e.g., oil pan). The oil returned to the oil reservoir 702 may then be used from lubrication purposes for one or more systems, aspects, or components of the diesel engine. For example, oil from the oil reservoir 702 may be used to provide lubrication for the crank of the diesel engine.

The depicted oil output module 700 includes a manifold (not shown in FIG. 7; for an example of a manifold for an oil output module, see oil output manifold 350 of FIG. 3), an outlet port 710, and an oil hose 720. Oil from one or more coalescers may be provided to the oil reservoir 702 via the oil hose 720, with the oil hose 720 fluidly coupled with one or more coalescers via a port or manifold. It may be noted that the oil hose 720 may be devoid of an oil trap. The outlet port 710, which may have one or more elbows and/or turns and terminate in a threaded fitting accepted by the oil reservoir 702, is configured to provide a fluid tight seal between the oil hose 720 and the oil reservoir 702. By returning the oil separated from the blow-by mixture to the oil reservoir 702, various embodiments reduce waste of oil and/or reduce emissions related to the venting of oil to the atmosphere.

Returning to FIG. 1, the outlet gas module 150 is configured to receive a gas vent supply from the coalescer 110 and provide the gas vent supply to the exhaust conduit 108. The outlet gas module 150 may be understood as a conduit between the coalescer 110 and the exhaust conduit 108 through which gases to be vented to the atmosphere (e.g., gases from which oil has been separated and/or gases from a boost air supply) flow from the coalescer 110 to the exhaust conduit 108 of the diesel engine 102. The outlet gas module 150 may include a port or manifold for accepting outlet gases from one or more coalescers (e.g., gases from which oil has been separated by the one or more coalescers)

Figure 8:
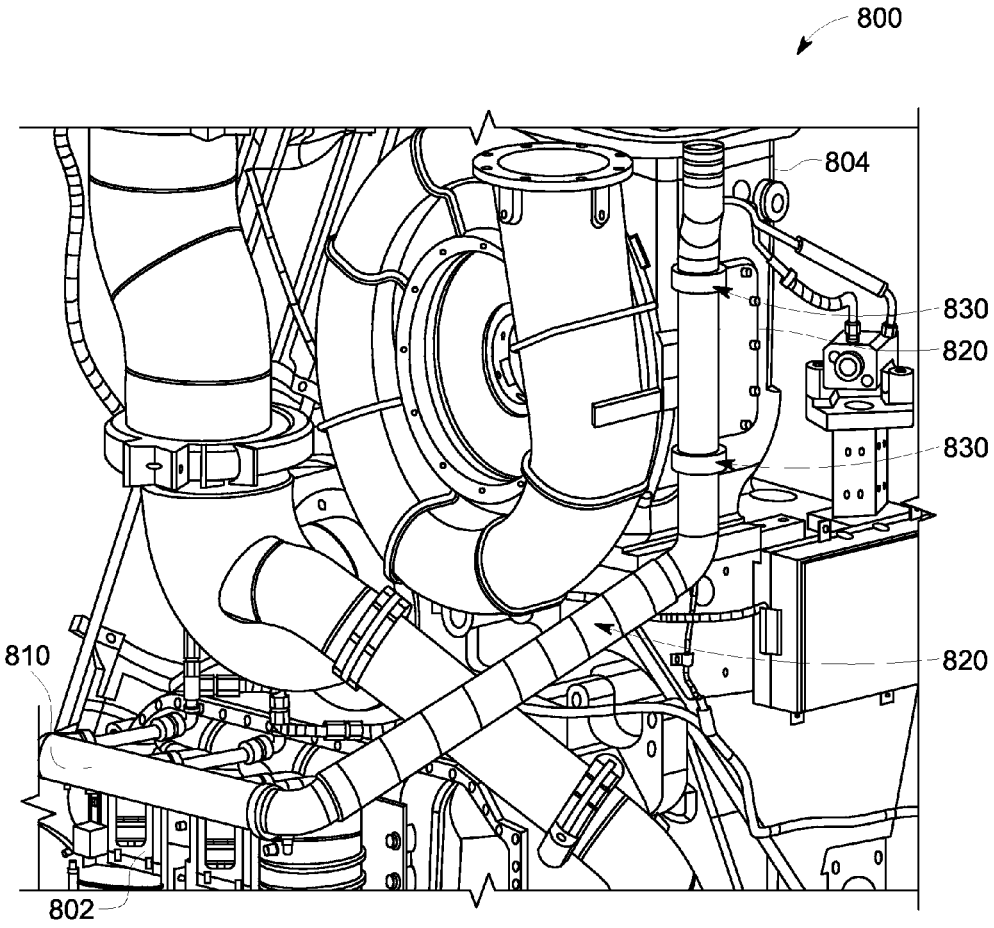
FIG. 8 provides a perspective view of an outlet gas module, according to an embodiment.
Figure 9:
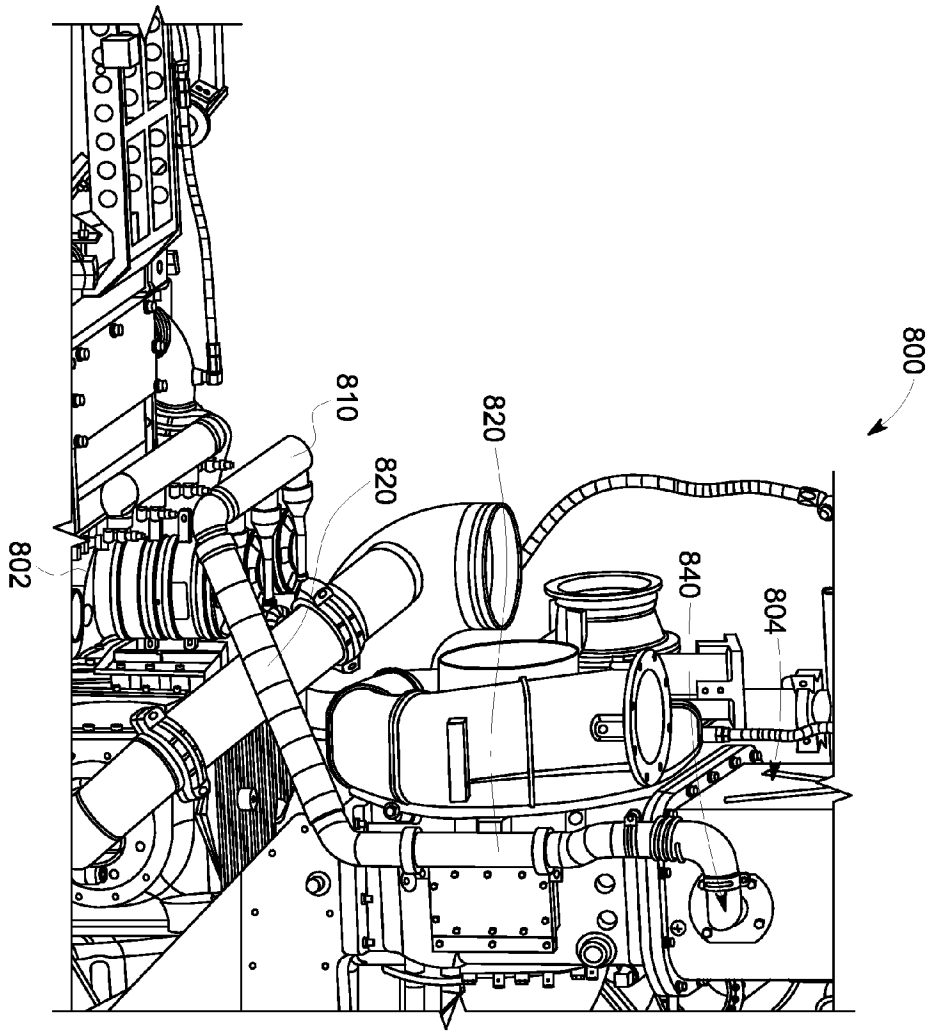
FIG. 9 provides an additional perspective view of the outlet gas module of FIG. 8.

FIGS. 8 and 9 provide perspective views of an outlet gas module 800 formed in accordance with an example of the present inventive subject matter (see also FIG. 2 for an additional view of the depicted assembly). The outlet gas module is configured to provide outlet gases from one or more coalescers 802 to an exhaust conduit 804. For example, the exhaust conduit 804 may be a muffler of an exhaust system configured for the expulsion of products of combustion from the diesel engine.

The depicted outlet gas module includes an outlet gas manifold 810, outlet gas piping 820, clamps 830, and a stack outlet 840. The outlet gas manifold, which may be made of a generally flexible material, accepts outlet gases from the one or more coalescers 802. The outlet gases 802 pass through the outlet gas piping 820 and into the exhaust conduit 804 via the stack outlet 840. The stack outlet 840, for example, may be configured as an exit port of the outlet gas module 800 and have a threaded fitting accepted by a port of the exhaust conduit 804 (e.g., a port or inlet disposed on a muffler). The clamps 830, which may be configured as "p"-shaped claims, may be used to secure the outlet gas piping 820 in place.

Returning to FIG. 1, the bracket 160 is configured to secure the coalescer 110 to the diesel engine 102. In the illustrated embodiment, the coalescer 110 is secured to the diesel engine 102 proximate the front end 198 of the diesel engine 102, for example to an intercooler 106, via the bracket 160. For example, the bracket 160 may be secured to an EGR intercooler disposed on the front end 198 of the diesel engine 102 generally directly below an air intake of the diesel engine 102. The EGR intercooler may provide, for example, a sufficient area to mount one or more coalescers without requiring removing or re-routing other engine components, and/or provide for a relatively short travel distance for one or more of a hose from an intake conduit to one or more coalescers, a hose from one or more coalescers to an oil reservoir, a conduit from one or more coalescers to an exhaust stack, or a conduit from a crankcase to one or more coalescers.

Figure 10:
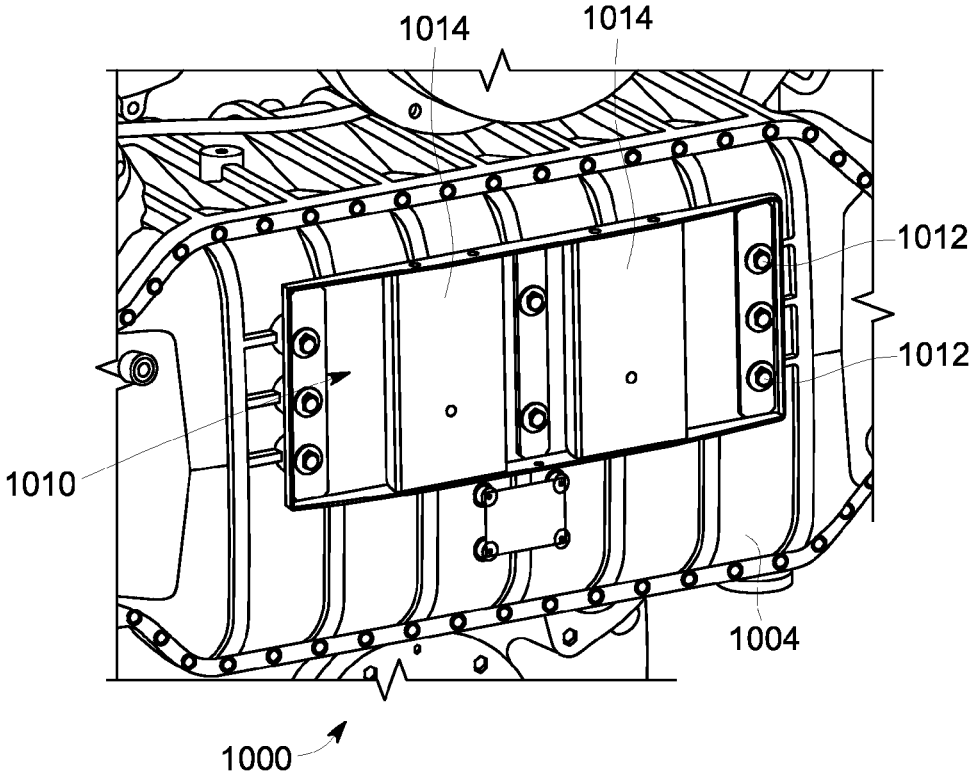
FIG. 10 provides a perspective view of a bracket base, according to an embodiment.
Figure 11:
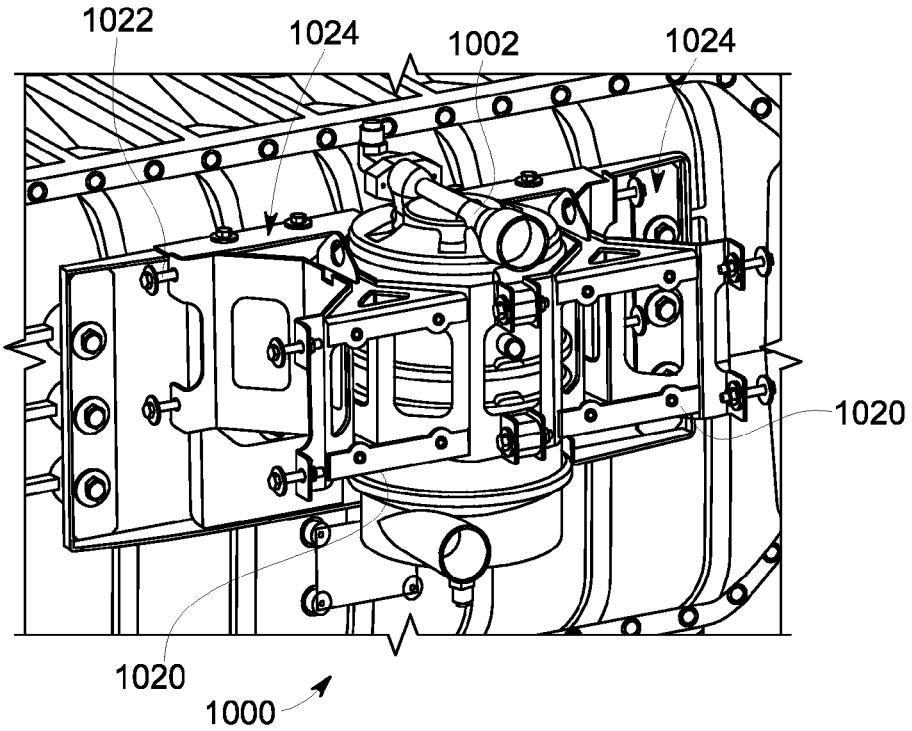
FIG. 11 provides a perspective view of a bracket with one coalescer secured by the bracket, according to an embodiment.
Figure 12:
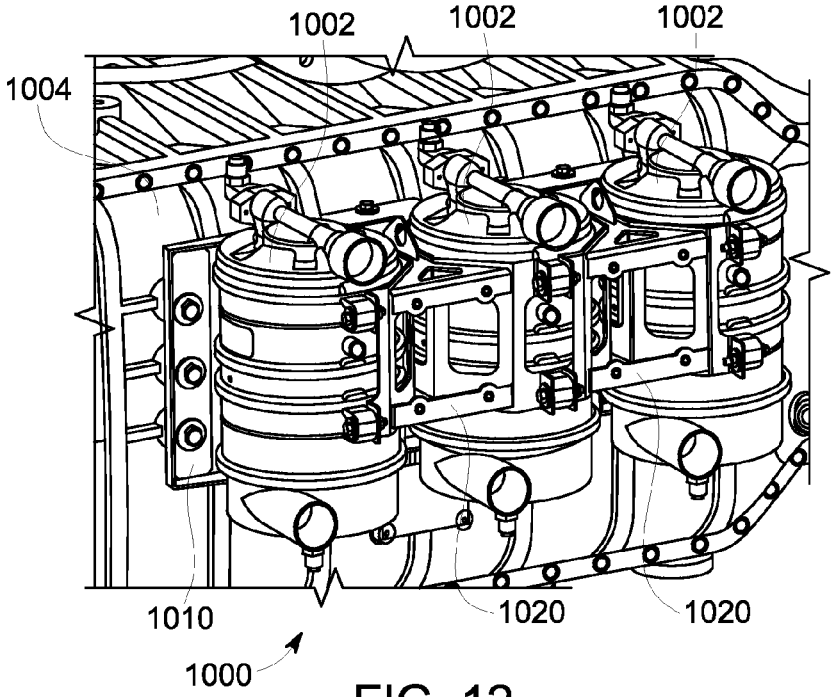
FIG. 12 provides a perspective view of the bracket of FIG. 11 with three coalescers secured by the bracket.

FIGS. 10, 11, and 12 provide perspective views of a bracket assembly 1000 formed in accordance with an example of the present inventive subject matter (see also FIG. 2 for an additional view of the depicted assembly). The bracket assembly 1000 is configured to mount one or more coalescers 1002 (e.g., three coalescers in the depicted embodiments) to an intercooler 1004 disposed at the front end of a diesel engine. For example, the intercooler 1004 may be an EGR cooler. The depicted bracket assembly 1000 includes a bracket base 1010 and bracket arms 1020. The bracket base 1010 is configured to mount to the intercooler 1004. The bracket arms 1020 define cavities 1024 that accept at least a portion of one of the coalescers 1002. The bracket arms 1020 are securable to the bracket base 101 to secure the coalescers 1002 to the intercooler 1004.

For example, as best seen in FIG. 10, the bracket base 1010 is configured to be mounted to the intercooler 1004 via bolts 1012. The intercooler 1004 may be configured with a thicker surface, a raised surface, pads, or the like to allow sufficient depth of threaded holes for securing the bracket base 1010 to the intercooler 1004. As seen in FIG. 10, the depicted bracket base 1010 includes mounting areas 1014. The mounting areas 1014 are configured as raised surfaces for mounting of the bracket arms 1020 to the bracket base 1010.

With the bracket base 1010 secured to the intercooler 1004, the bracket arms 1020 may be secured to the bracket base 1010. As best seen in FIG. 11, the bracket arms 1020 may be secured to the bracket base 1010 via bolts 1022. The bolts 1022 may thread into an edge of the raised surfaces of the mounting areas 1014, or, as another example, may be used to secure the bracket arms 1020 to the mounting areas 1014 via a clamping action. The bolts 1022 may further include additional threading portions for securing the coalescers 1002 to the bracket arms 1020. The bracket arms 1020 define cavities 1024 that accept the coalescers 1002. In FIG. 11, two bracket arms 1020 are shown securing one coalescer 1002 in a central cavity defined by an internal portion (e.g., oriented toward the center of the bracket 1000) of each bracket arm 1020. Further, each bracket arm 1020 defines a cavity 1024 unique to that particular arm oriented as an external cavity (e.g., toward an edge of the bracket 1000) configured to accept an additional coalescer, so that the depicted bracket 1000 may accept and secure three coalescers 1002 to the intercooler 1004. FIG. 12 provides a view of three coalescers 1002 secured to the intercooler 1004.

Mounting a coalescer proximate the front end of an engine, for example as depicted in FIGS. 10-12, may provide for a secure mounting location large enough to accept plural coalescers, provide for convenient installation and subsequent access to aspects of a coalescer system, and/or provide for relatively short conduit runs between a coalescer and pertinent aspects of the diesel engine. Further, the coalescer mounting depicted in FIGS. 10-12 may fit entirely or nearly entirely within a defined volumetric envelope of the engine without the coalescers, allowing for convenient fit within an engine cab.

Figure 13:
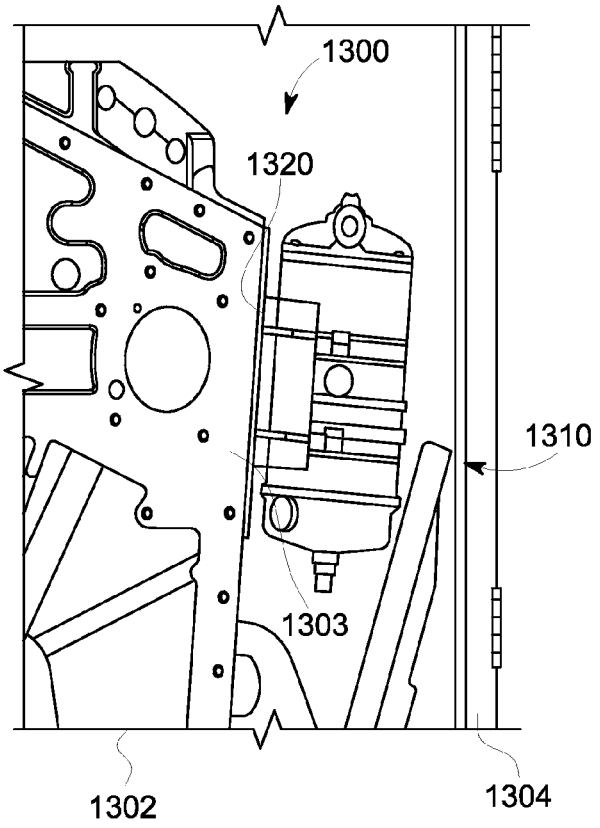
FIG. 13 provides a perspective view of an alternate mounting of a coalescer system, according to an embodiment.

It may be noted, however, that alternate mounting positions may be employed in various alternate embodiments. For example, FIG. 13 provides a perspective view of an alternate mounting of a coalescer system 1300 in accordance with an example of the present inventive subject matter. The various flows into and out of a coalescer 1310 of the coalescer system 1300 may be generally similar as for the coalescer 110 discussed in connection with FIGS. 1 and 2. However, as seen in FIG. 13, the coalescer 1310 of the coalescer system 1300 is mounted to a cam cover 1303 of an engine block 1302 via a bracket 1320. As seen in FIG. 13, the coalescer 1310 may be understood as being mounted parallel to the cam cover 1303. As each cam cover may have a coalescer mounted thereto, the arrangement of FIG. 13 provides for the use of multiple coalescers.

In contrast to the examples discussed in connection with FIGS. 1-12, however, the blow-by mixture may be provided to the coalescer 1310 from the rear end of a diesel engine (e.g., the end opposite an air intake opening). Further, a boost air supply may be provided from a port disposed at a rear end of an intake manifold receiving air from the intake opening at the front end of the engine. Depending on the specific layout of the engine, an arrangement as shown in FIG. 13, when compared to the arrangement of FIGS. 1-12, may require additional lengths of conduits from the coalescer to pertinent aspects of the diesel engine, result in challenges providing clearance from the engine cab 1304, have reduced convenience of access and serviceability, or the like.

Figure 14:
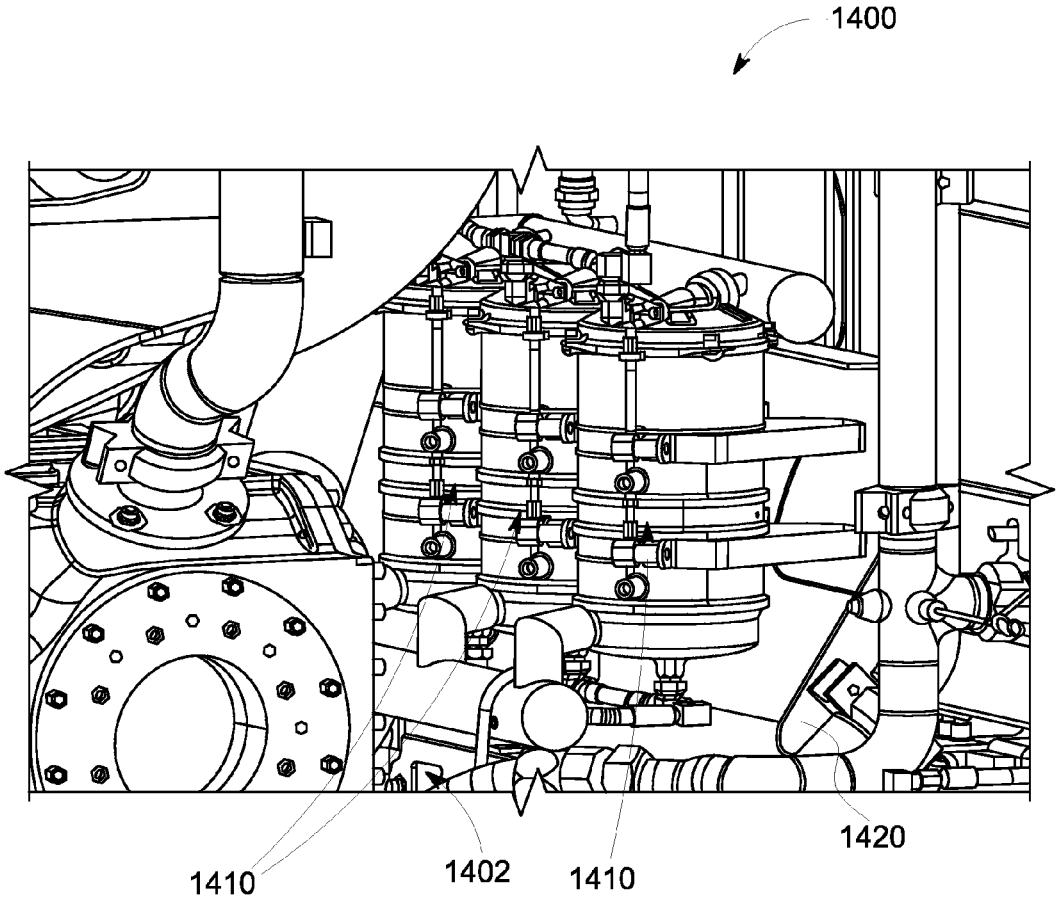
FIG. 14 provides a perspective view of an additional alternate mounting of a coalescer system, according to an embodiment.

FIG. 14 provides a perspective view of an additional alternate mounting of a coalescer system 1400 in accordance with an example of the present inventive subject matter. The various flows into and out of a coalescer 1410 of the coalescer system 1400 may be generally similar as for the coalescer 110 discussed in connection with FIGS. 1 and 2. However, as seen in FIG. 14, the three coalescers 1410 of the coalescer system 1400 are mounted, via a bracket 1420, to oil cooler 1402 of a diesel engine. Similar to examples discussed in connection with FIGS. 1-12, the coalescers 1410 may be mounted at or near the front end of a diesel engine.

However, mounting the coalescers 1410 on top of the oil cooler moves the coalescers outside of an engine environment, in contrast to the mounting depicted in FIGS. 10-12. Thus, while the coalescers 1002 or coalescer 110 may be installed on the engine prior to mounting or installing the engine on a vehicle, the coalescers 1410 may be installed after the engine and oil cooler are installed, which can lead to more difficult installation. Further, the oil cooler 1402 may be more susceptible to movement than, for example, an EGR intercooler. Further, the oil cooler may be required to be dismantled before servicing the coalescers 1410, in contrast to the coalescer 110 or coalescers 1002 which may be serviced without dismantling other engine components. Compared to the examples of FIGS. 10-12, the mounting depicted in FIG. 14 may result in increased complexity and lengthening of piping and/or hosing runs form the coalescer to the pertinent aspects of the diesel engine.

Figure 15:
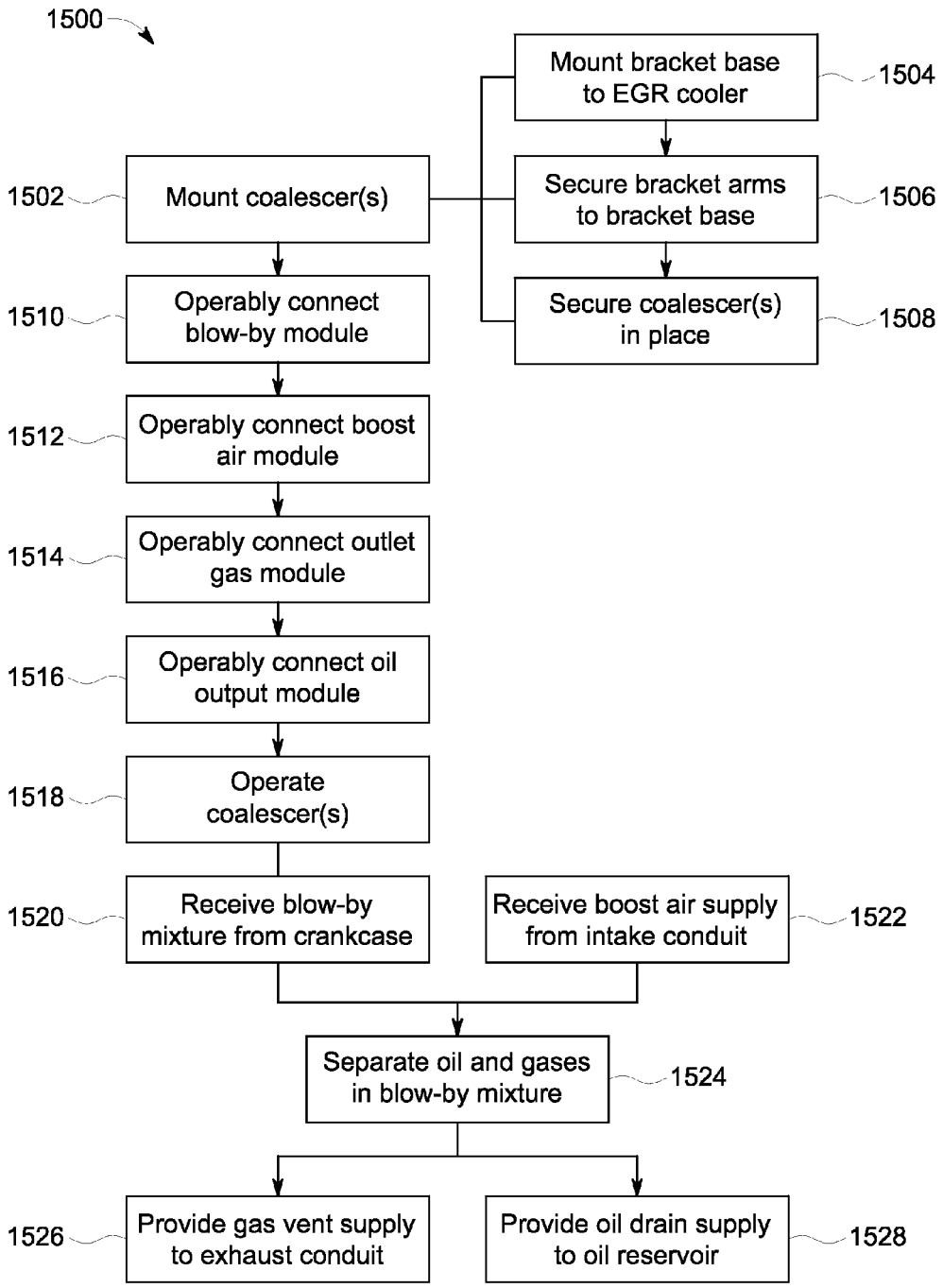
FIG. 15 is a flowchart of a method for providing and using a coalescer system, according to an embodiment.

FIG. 15 illustrates a flowchart of a method 1500 for providing and/or using a coalescing system in accordance with an example of the present inventive subject matter. The method 1500 may be performed, for example, using certain components, equipment, structures, or other aspects of embodiments discussed herein. In certain embodiments, certain steps may be added or omitted, certain steps may be performed simultaneously or concurrently with other steps, certain steps may be performed in different order, and certain steps may be performed more than once, for example, in an iterative fashion.

At 1502, a bracket and one or more coalescers are mounted to a diesel engine. The bracket may be configured to secure the one or more coalescers in place and may be mounted to a portion of the engine. For example, the bracket and one or more coalescers may be mounted to a readily accessible exterior surface of an intercooler (e.g., an EGR intercooler) disposed proximate a front end of the diesel engine. (See, e.g., FIGS. 10-12.) The coalescer in various examples is configured to receive a blow-by mixture from the diesel engine, and to separate oil in the blow-by mixture from one or more gases (e.g., a fuel/air mixture) of the blow-by mixture. The coalescer may provide a gas vent supply of the gases and an oil drain supply of the separated oil. The coalescer may also be configured to receive a boost air supply, for example, to provide a vacuum for improved separation of oil from the gases in the blow-by mixture.

In some examples, the mounting of the bracket and one or more coalescers may be performed using substeps 1504-1508. At 1504, a bracket base is mounted to a surface of an EGR cooler, for example using bolts. At 1506, bracket arms defining cavities are secured to the bracket base. At 1508, one or more coalescers are secured to the EGR intercooler via the bracket arms and base. For example, each coalescer may be bolted, clamped, or the like to one or more bracket arms. It may be noted that the substeps 1506 and 1508 may be performed simultaneously, concurrently, or iteratively. For example, to mount three coalescers, a first coalescer unit may be mounted between two bracket arms which are then secured to the bracket base. The two remaining intercoolers may subsequently each be secured within an external cavity of the two bracket arms, respectively. (See, e.g., FIGS. 11-12.)

At 1510, a blow-by input module is operably connected between at least one coalescer and a crankcase of the diesel engine. The blow-by input module receives the blow-by mixture from a crankcase of the diesel engine and provides the blow-by mixture to the at least one coalescer. The blow-by input module may include one or more of a pipe, hose, port, manifold, fitting, or the like.

At 1512, a boost air module is operably connected between the at least one coalescer and an intake conduit of the diesel engine. The boost air module receives an air supply from an intake conduit of the diesel engine and provides the air supply as the operational air supply (e.g., an air supply used to provide a vacuum or pressure differential for improved separation) to the at least one coalescer. The boost air module, for example, may include a hose leading from an intake conduit of the diesel engine to fittings or ports of one or more coalescers.

At 1514, an outlet gas module is operably connected between the at least one coalescer and an exhaust conduit (e.g., muffler) of a diesel engine. The outlet gas module is configured to receive the gas vent supply from the at least one coalescer and to provide the gas vent supply to the exhaust conduit of the diesel engine. The outlet gas module may include one or more of a pipe, hose, port, manifold, fitting, or the like.

At 1516, an oil output module is operably connected between the at least one coalescer and an oil reservoir of the diesel engine. The oil output module receives the oil drain supply from the at least one coalescer and provides the oil drain supply to the oil reservoir of the diesel engine. The oil output module, for example, may include a hose leading from the at least one coalescer to a fitting or port of the oil reservoir (e.g., oil pan).

At 1518, the at least one coalescer is operated, for example, pursuant to substeps 1520-1528. With the diesel engine running, blow-by mixture from the crankcase is routed to the at least one coalescer at 1520. At 1522, the coalescer receives a boost air supply from an intake conduit of the diesel engine via the boost air module to provide improved separation. Using the boost air supply, at 1524, the at least one coalescer separates the blow-by mixture to a gaseous stream or gas vent supply and to an oil drain supply include oil separated from the gases received from the crankcase. At 1526, the gas vent supply is provided to the exhaust conduit and expelled to the atmosphere, while, at 1528, the oil drain supply is returned to the oil reservoir for further use by the diesel engine.

In an example of the present inventive subject matter, a coalescing system includes at least one coalescer, a blow-by input module, and a boost air module. The at least one coalescer is configured to receive a blow-by mixture from an internal combustion engine, to remove oil from the blow-by mixture to provide an oil drain supply from the at least one coalescer, and to remove gas from the blow-by mixture to provide a gas vent supply from the at least one coalescer. The coalescer is configured to receive an operational air supply. The blow-by input module is operably coupled to the at least one coalescer and configured to receive the blow-by mixture from a crankcase of the internal combustion engine and provide the blow-by mixture to the at least one coalescer. The boost air module is operably coupled to the at least one coalescer and configured to receive an air supply from an intake conduit of the internal combustion engine and to provide the air supply as the operational air supply to the at least one coalescer.

In another aspect, the coalescing system further includes an outlet gas module operably coupled to the at least one coalescer and configured to receive the gas vent supply from the coalescer and to provide the gas vent supply to an exhaust conduit of the internal combustion engine.

In another aspect, the coalescing system further includes an oil output module operably coupled to the at least one coalescer and configured to receive the oil drain supply from the at least one coalescer and to provide the oil drain supply to an oil reservoir of the internal combustion engine.

In another aspect, the coalescing system further includes a bracket configured to mount the at least one coalescer to a front end of the internal combustion engine, the front end corresponding to an intake end of the internal combustion engine. For example, the bracket may be configured to mount the at least one coalescer to an intercooler disposed on the front end of the internal combustion engine. Further, the bracket may include a bracket base and at least one bracket arm, with the bracket base configured to mount to the intercooler, and the at least one bracket arm defining at least one cavity configured to accept at least a portion of the at least one coalescer. The at least one bracket arm may be securable to the bracket base to secure the at least one coalescer to the intercooler.

In another aspect, the at least one coalescer includes a plurality of coalescers, and the at least one bracket arm comprises a plurality of bracket arms configured to secure the plurality of coalescers to the intercooler.

In another aspect, the blow-by input module comprises at least one rigid pipe and at least one flexible hose.

In an example of the present inventive subject matter, a system includes an internal combustion engine, at least one coalescer, a blow-by input module, and a boost air module. The internal combustion engine includes an intake conduit configured to provide an inlet stream of air for combustion by the internal combustion engine, a crankcase, an exhaust conduit configured to provide an outlet for combustion products, and an oil reservoir. The at least one coalescer is configured to receive a blow-by mixture from the crankcase of the internal combustion engine, to remove oil from the blow-by mixture to provide an oil drain supply from the at least one coalescer, and to remove gas from the blow-by mixture to provide a gas vent supply from the at least one coalescer. The coalescer is also configured to receive an operational air supply. The blow-by input module is operably coupled to the at least one coalescer and configured to receive the blow-by mixture from the crankcase of the internal combustion engine and provide the blow-by mixture to the at least one coalescer. The boost air module is operably coupled to the at least one coalescer and configured to receive an air supply from the intake conduit of the internal combustion engine and to provide the air supply as the operational air supply to the at least one coalescer.

In another aspect, the system also includes an outlet gas module operably coupled to the at least one coalescer and configured to receive the gas vent supply from the at least one coalescer, and to provide the gas vent supply to the exhaust conduit of the internal combustion engine.

In another aspect, the system also includes an oil output module operably coupled to the at least one coalescer and configured to receive the oil drain supply from the at least one coalescer, and to provide the oil drain supply to the oil reservoir of the internal combustion engine.

In another aspect, the system includes a bracket configured to mount the at least one coalescer to a front end of the internal combustion engine, with the front end corresponding to an intake end of the internal combustion engine. For example, the bracket may be configured to mount the at least one coalescer to an intercooler disposed on the front end of the internal combustion engine.

In an example of the present inventive subject matter, a method includes positioning at least one coalescer proximate to an internal combustion engine. The at least one coalescer is configured to receive a blow-by mixture from an internal combustion engine, to remove oil from the blow-by mixture to provide an oil drain supply from the at least one coalescer, and to remove gas from the blow-by mixture to provide a gas vent supply from the at least one coalescer. The coalescer is configured to receive an operational air supply. The method also includes operably connecting a blow-by input module to the at least one coalescer and to a crankcase of the internal combustion engine, wherein the blow-by input module receives the blow-by mixture from a crankcase of the internal combustion engine and provides the blow-by mixture to the at least one coalescer. Further, the method includes operably connecting a boost air module to the at least one coalescer and an intake conduit of the internal combustion engine, wherein the boost air module receives an air supply from an intake conduit of the internal combustion engine and provides the air supply as the operational air supply to the at least one coalescer.

In another aspect, the method includes operably coupling an outlet gas module to the at least one coalescer and an exhaust conduit of the internal combustion engine, wherein the outlet gas module receives the gas vent supply from the coalescer and provides the gas vent supply to the exhaust conduit of the internal combustion engine.

In another aspect, the method includes operably coupling an oil output module to the at least one coalescer and to an oil reservoir of the internal combustion engine, wherein the oil output module receives the oil drain supply from the at least one coalescer and provides the oil drain supply to the oil reservoir of the internal combustion engine.

In another aspect, the method includes securing the at least one coalescer to a front end of the internal combustion engine, the front end corresponding to an intake end of the internal combustion engine. For example, securing the at least one coalescer to the front end of the internal combustion engine may include securing the at least one coalescer to an intercooler disposed proximate the front end of the internal combustion engine. For instance, securing the at least one coalescer to the intercooler may include securing a bracket base to the intercooler, and securing one or more bracket arms to the bracket base, with the one or more bracket arms comprising at least one cavity configured to accept at least one of the at least one coalescers.

In another aspect, the at least one coalescer comprises three coalescers mounted to an intercooler disposed proximate a front end of the internal combustion engine It is to be understood that the above description is intended to be illustrative, and not restrictive. For example, the above-described embodiments (and/or aspects thereof) may be used in combination with each other. In addition, many modifications may be made to adapt a particular situation or material to the teachings without departing from its scope. While the dimensions and types of materials described herein are intended to define the parameters, they are by no means limiting and are exemplary embodiments. Many other embodiments will be apparent to one of ordinary skill in the art upon reviewing the above description. The scope should, therefore, be determined with reference to the appended claims, along with the full scope of equivalents to which such claims are entitled. In the appended claims, the terms "including," "includes," and "in which" are used as the plain-English equivalents of the respective terms "comprising," "comprises," and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

This written description uses examples to disclose several embodiments, and also to enable any person skilled in the art to practice the embodiments, including making and using any devices or systems and performing any incorporated methods. The patentable scope is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described systems and methods, without departing from the spirit and scope of the embodiments described herein, it is intended that all of the subject matter of the above description or shown in the accompanying drawings shall be interpreted merely as examples illustrating the inventive subject matter herein and shall not be construed as limiting.

The invention claimed is:

1. A coalescing system comprising:

at least one coalescer configured to receive a blow-by mixture from an internal combustion engine, to remove oil from the blow-by mixture to provide an oil drain supply from the at least one coalescer, and to remove gas from the blow-by mixture to provide a gas vent supply from the at least one coalescer, the at least one coalescer configured to receive an operational air supply for separating the oil from the blow-by mixture;

a blow-by input module operably coupled to the at least one coalescer and configured to receive the blow-by mixture from a crankcase of the internal combustion engine and provide the blow-by mixture to the at least one coalescer;

a boost air module operably coupled to the at least one coalescer and configured to receive an air supply from an intake conduit of the internal combustion engine and to provide the air supply as the operational air supply to the at least one coalescer, the operational air supply for separating oil from the blow-by mixture, the intake conduit configured to provide an inlet stream of air for combustion by the internal combustion engine; and a bracket configured to mount the at least one coalescer to a front end of the internal combustion engine, the front end corresponding to an intake end of the internal combustion engine.

2. The coalescing system of claim 1, further comprising an outlet gas module operably coupled to the at least one coalescer and configured to receive the gas vent supply from the at least one coalescer and to provide the gas vent supply to an exhaust conduit of the internal combustion engine.

3. The coalescing system of claim 1, further comprising an oil output module operably coupled to the at least one coalescer and configured to receive the oil drain supply from the at least one coalescer and to provide the oil drain supply to an oil reservoir of the internal combustion engine.

4. The coalescing system of claim 1, wherein the bracket is mounted directly below an air intake of the internal combustion engine.

5. The coalescing system of claim 1, wherein the bracket is configured to mount the at least one coalescer to an intercooler disposed on the front end of the internal combustion engine.

6. The coalescing system of claim 5, wherein the bracket comprises a bracket base and at least one bracket arm, the bracket base configured to mount to the intercooler, the at least one bracket arm defining at least one cavity configured to accept at least a portion of the at least one coalescer, the at least one bracket arm securable to the bracket base to secure the at least one coalescer to the intercooler.

7. The coalescing system of claim 6, wherein the at least one coalescer includes a plurality of coalescers, and the at least one bracket arm comprises a plurality of bracket arms configured to secure the plurality of coalescers to the intercooler.

8. The coalescing system of claim 1, wherein the blow-by input module comprises at least one rigid pipe and at least one flexible hose.

9. A system comprising:

an internal combustion engine comprising an intake conduit configured to provide an inlet stream of air for combustion by the internal combustion engine, a crankcase, an exhaust conduit configured to provide an outlet for combustion products, and an oil reservoir;

at least one coalescer configured to receive a blow-by mixture from the crankcase of the internal combustion engine, to remove oil from the blow-by mixture to provide an oil drain supply from the at least one coalescer, and to remove gas from the blow-by mixture to provide a gas vent supply from the at least one coalescer, the at least one coalescer configured to receive an operational air supply for separating the oil from the blow-by mixture;

a blow-by input module operably coupled to the at least one coalescer and configured to receive the blow-by mixture from the crankcase of the internal combustion engine and provide the blow-by mixture to the at least one coalescer;

a boost air module operably coupled to the at least one coalescer and configured to receive an air supply from the intake conduit of the internal combustion engine and to provide the air supply as the operational air supply to the at least one coalescer; and a bracket mounted proximate to a front end of the internal combustion engine, wherein the intake conduit of the internal combustion engine is disposed proximate the front end of the internal combustion engine, the at least one coalescer mounted to the bracket to secure the at least one coalescer to the front end of the internal combustion engine.

10. The system of claim 9, further comprising an outlet gas module operably coupled to the at least one coalescer and configured to receive the gas vent supply from the at least one coalescer and to provide the gas vent supply to the exhaust conduit of the internal combustion engine.

11. The system of claim 9, further comprising an oil output module operably coupled to the at least one coalescer and configured to receive the oil drain supply from the at least one coalescer and to provide the oil drain supply to the oil reservoir of the internal combustion engine.

12. The system of claim 9, wherein the bracket is mounted directly below an air intake of the internal combustion engine.

13. The system of claim 9, wherein the bracket is mounted to an intercooler disposed on the front end of the internal combustion engine.

14. A method comprising:

positioning at least one coalescer proximate to an internal combustion engine, the at least one coalescer configured to receive a blow-by mixture from the internal combustion engine, to remove oil from the blow-by mixture to provide an oil drain supply from the at least one coalescer, and to remove gas from the blow-by mixture to provide a gas vent supply from the at least one coalescer, the at least one coalescer configured to receive an operational air supply for separating the oil from the blow-by mixture; wherein positioning the at least one coalescer comprises mounting the at least one coalescer to a bracket mounted proximate to a front end of the internal combustion engine, the front end corresponding to an intake end of the internal combustion engine;

operably connecting a blow-by input module to the at least one coalescer and to a crankcase of the internal combustion engine, wherein the blow-by input module receives the blow-by mixture from a crankcase of the internal combustion engine and provides the blow-by mixture to the at least one coalescer;

operably connecting a boost air module to the at least one coalescer and an intake conduit of the internal combustion engine, wherein the boost air module receives an air supply from an intake conduit of the internal combustion engine and provides the air supply as the operational air supply to the at least one coalescer, the intake conduit configured to provide an inlet stream of air for combustion by the internal combustion engine.

15. The method of claim 14, further comprising operably coupling an outlet gas module to the at least one coalescer and an exhaust conduit of the internal combustion engine, wherein the outlet gas module receives the gas vent supply from the at least one coalescer and provides the gas vent supply to the exhaust conduit of the internal combustion engine.

16. The method of claim 14, further comprising operably coupling an oil output module to the at least one coalescer and to an oil reservoir of the internal combustion engine, wherein the oil output module receives the oil drain supply from the at least one coalescer and provides the oil drain supply to the oil reservoir of the internal combustion engine.

17. The method of claim 14, wherein the bracket is mounted directly below an air intake of the internal combustion engine.

18. The method of claim 14, wherein securing the at least one coalescer to the front end of the internal combustion engine comprises securing the at least one coalescer to an intercooler disposed proximate the front end of the internal combustion engine.

19. The method of claim 18, wherein securing the at least one coalescer to the intercooler comprises:

securing a bracket base to the intercooler; and securing one or more bracket arms to the bracket base, the one or more bracket arms comprising at least one cavity configured to accept at least one of the at least one coalescers.

20. The method of claim 14, wherein the at least one coalescer comprises three coalescers mounted to an intercooler disposed proximate a front end of the internal combustion engine, the front end corresponding to an intake end of the internal combustion engine.

* * * * *